US008955967B2

(12) United States Patent
Kawakami et al.

(10) Patent No.: US 8,955,967 B2
(45) Date of Patent: Feb. 17, 2015

(54) PRINTING APPARATUS WITH AN OPENABLE COVER STRUCTURE

(71) Applicant: Canon Kabushiki Kaisha, Tokyo (JP)

(72) Inventors: Kazuhisa Kawakami, Yokohama (JP); Yasuhito Tsubakimoto, Tokyo (JP); Toshiaki Harada, Kawasaki (JP); Masaya Shimmachi, Kawasaki (JP); Kaneto Tokuyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/930,333

(22) Filed: Jun. 28, 2013

(65) Prior Publication Data

US 2014/0009553 A1 Jan. 9, 2014

(30) Foreign Application Priority Data

Jul. 5, 2012 (JP) ..... 2012-151461

(51) Int. Cl.

| | |
|---|---|
| ***B41J 29/13*** | (2006.01) |
| ***B41J 2/01*** | (2006.01) |
| ***B41J 29/02*** | (2006.01) |

(52) U.S. Cl.

CPC .. *B41J 2/01* (2013.01); *B41J 29/02* (2013.01); *B41J 29/13* (2013.01)

USPC ..... 347/108; 347/19

(58) Field of Classification Search

CPC ..... B41J 29/13; B41J 29/02

USPC ..... 347/108, 19

See application file for complete search history.

(56) References Cited

U.S. PATENT DOCUMENTS

| | | | | |
|---|---|---|---|---|
| 6,065,831 | A | 5/2000 | Kawaura | |
| 8,201,937 | B2 * | 6/2012 | Nobuta et al. | 347/108 |
| 2005/0146591 | A1 * | 7/2005 | Ogata et al. | 347/108 |
| 2009/0102904 | A1 * | 4/2009 | Silverbrook et al. | 347/86 |
| 2011/0134202 | A1 * | 6/2011 | Sekino et al. | 347/222 |

FOREIGN PATENT DOCUMENTS

| | | | |
|---|---|---|---|
| CN | 101659164 | A | 3/2010 |
| JP | 2007-15246 | A | 1/2007 |
| JP | 2010-012652 | A | 1/2010 |

* cited by examiner

*Primary Examiner* — Henok Legesse

(74) *Attorney, Agent, or Firm* — Canon USA Inc IP Division

(57) ABSTRACT

A printing apparatus includes a print head configured to discharge ink, a housing in which the print head is provided, the housing having an opening, a cover unit which is openable with respect to the opening, a detection unit configured to detect an opening of the cover unit, and a wall inside the housing arranged between the detection unit and the print head, wherein the wall is configured to establish a separation between a space where the detection unit is located and a space where the print head is located when the cover unit is in a closed state.

10 Claims, 11 Drawing Sheets

PRINTING APPARATUS WITH AN OPENABLE COVER STRUCTURE

BACKGROUND OF THE INVENTION

1. Field of the Invention

The present disclosure relates to an inkjet printing apparatus.

2. Description of the Related Art

Japanese Patent Application Laid-Open No. 2007-15246 discusses an inkjet printing apparatus that includes a main body having an opening formed thereon, a cover configured to open and close the opening, and a detection unit configured to detect opening and closing operations of the cover. In the inkjet printing apparatus, the detection unit is arranged on the cover. If the detection unit detects that the cover opens up the opening of the main body, ink tanks built in the main body automatically move to the center of the opening. The user can thus easily replace the ink tanks.

The main body of the inkjet printing apparatus also includes a print head for discharging ink, aside from the ink tanks. When the print head discharges ink, ink mist is generated. The generated ink mist floats inside the main body. In the inkjet printing apparatus discussed in Japanese Patent Application Laid-Open No. 2007-15246, the detection unit is exposed to the main body side when the opening of the main body is closed by the cover. The ink mist generated from the print head can thus adhere to the detection unit via the opening. The ink mist adhering to the detection unit may interfere with a stable detection operation.

SUMMARY OF THE INVENTION

The present disclosure is directed to an inkjet printing apparatus that makes ink mist less likely to adhere to the detection unit which detects opening and closing operations of the cover.

According to an aspect disclosed herein, (same as claim 1)

Further features of the present invention will become apparent from the following description of exemplary embodiments with reference to the attached drawings.

DESCRIPTION OF THE EMBODIMENTS

Figure 1A:
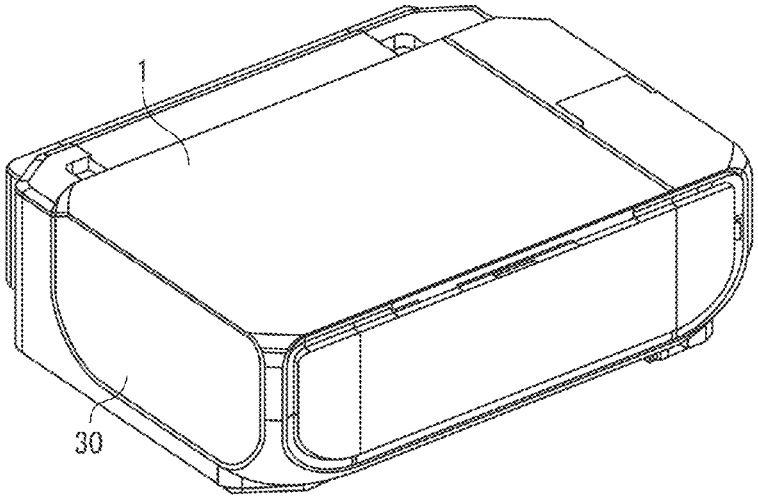
FIGS. 1A and 1B are perspective views of an inkjet printing apparatus according to a first exemplary embodiment.
Figure 1B:
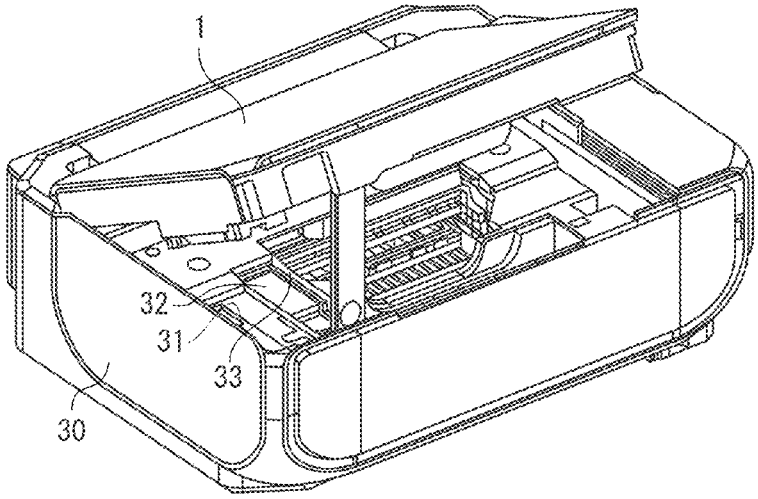

FIGS. 1A and 1B are perspective views of an inkjet printing apparatus according to a first exemplary embodiment. The inkjet printing apparatus includes a cover unit 1 and a main body 30 serving as a housing. The main unit 30 has an opening 31 formed thereon (see FIG. 1B). The cover unit 1 is openable (opens and closes) with respect to the opening 31. FIG. 1A illustrates a closed state where the cover unit 1 closes the opening 31. FIG. 1B illustrates an open state where the cover unit 1 opens up the opening 31. As illustrated in FIG. 1B, the opening 31 has a virtual plane parallel to a horizontal plane. The opening 31 appears and exposes an interior of the inkjet printing apparatus when the cover unit 1 is in the open state. The user can access the interior of the inkjet printing apparatus exposed in the opening 31 to perform maintenance, such as replacement of an ink tank and jamming handling.

The cover unit 1 may include an operation unit including an input button or buttons and a display for the user to operate the inkjet printing apparatus. The cover unit 1 may include a scanner unit, such as a flatbed scanner and a sheet-through scanner, for reading a document.

Figure 2A:
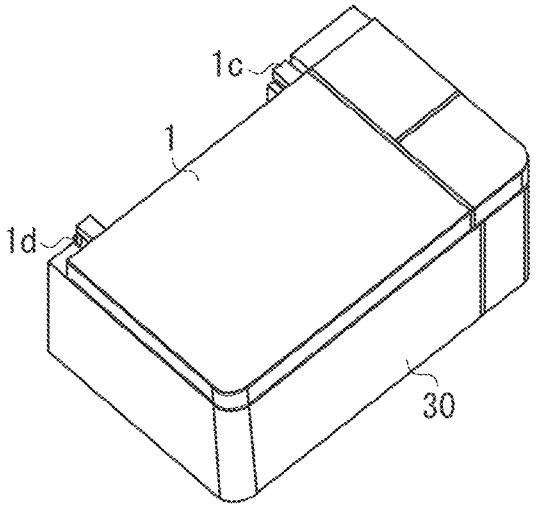
FIGS. 2A, 2B, and 2C are diagrams illustrating a connection form of a cover unit and a main body of the inkjet printing apparatus illustrated in FIGS. 1A and 1B.
Figure 2B:
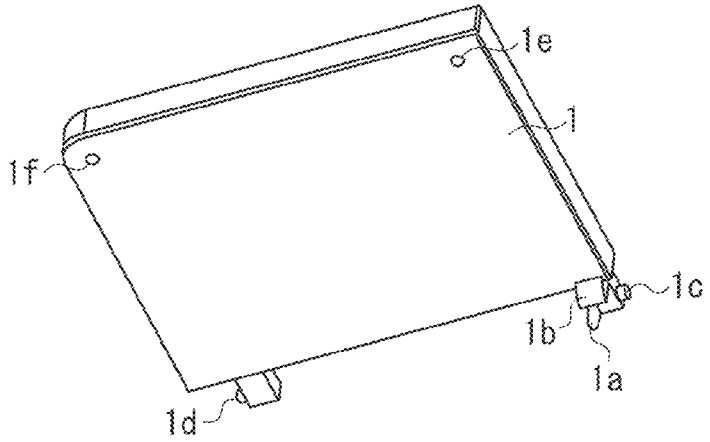
Figure 2C:
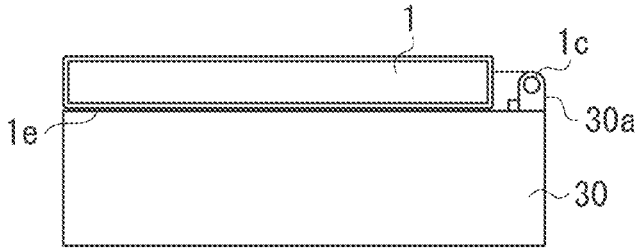

FIGS. 2A, 2B, and 2C are diagrams illustrating a connection form of the cover unit 1 and the main body 30 in the inkjet printing apparatus illustrated in FIGS. 1A and 1B. FIG. 2A is a perspective view illustrating a state where the cover unit 1 is attached to the main body 30. FIG. 2B is a perspective view of the cover unit 1 as seen from its lower surface (a surface opposed to the main body 30). FIG. 2C is a side view illustrating the state where the cover unit 1 is attached to the main body 30.

As illustrated in FIG. 2B, cylindrical shaft portions 1*c* and 1*d* are arranged on a rear side of the cover unit 1. The shaft portions 1*c* and 1*d* are supported by bearing portions 30*a* arranged on the main body 30 (see FIG. 2C). The cover unit 1 rotates about the shaft portions 1*c* and 1*d* to open and close the opening 31 (see FIG. 1B) of the main body 30. A protruding member 1*a* with a tapered shape and a protruding member 1*b* with a plate shape are arranged near the shaft portion 1*c*.

As illustrated in FIG. 2B, protrusions 1*e* and 1*f* are formed on the lower surface of the cover unit 1. When the cover unit 1 closes the opening 31 of the main body 30, the protrusions 1*e* and 1*f* contact the main body 30. The protrusions 1*e* and 1*f* determine an orientation of the cover unit 1.

Figure 3:
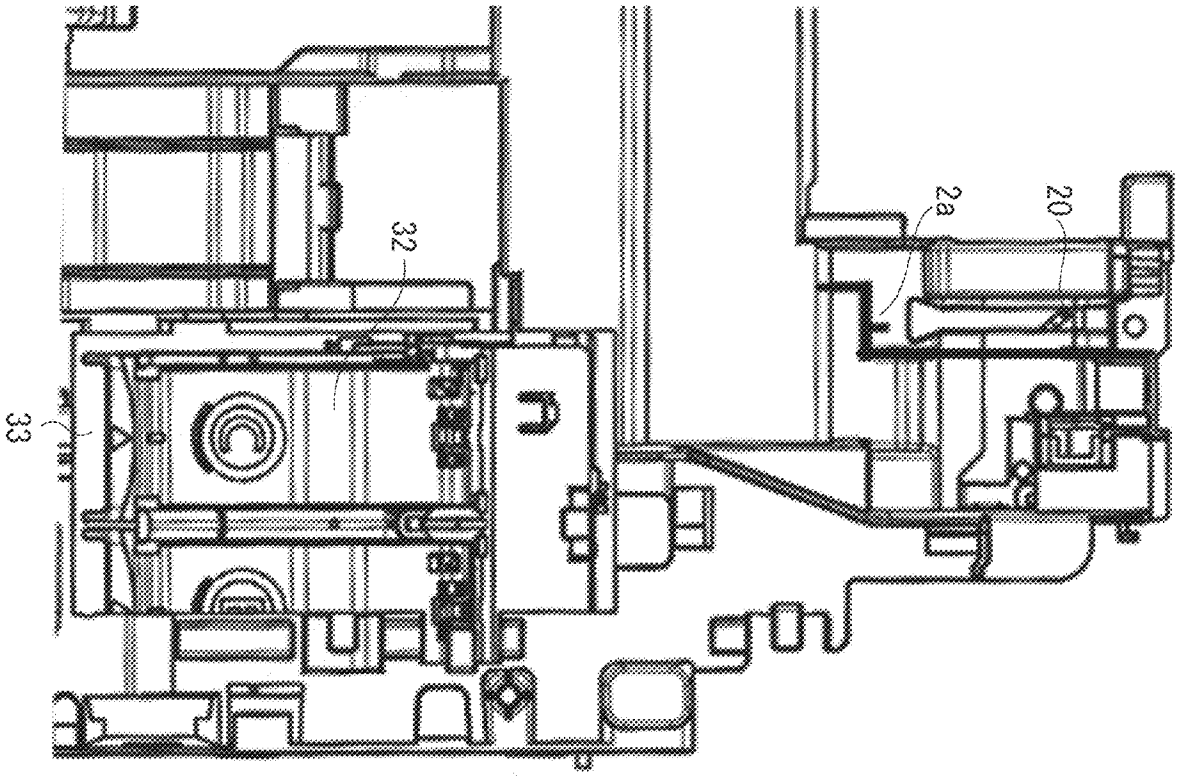
FIG. 3 is a plan view illustrating essential components of the main body.
Figure 4:
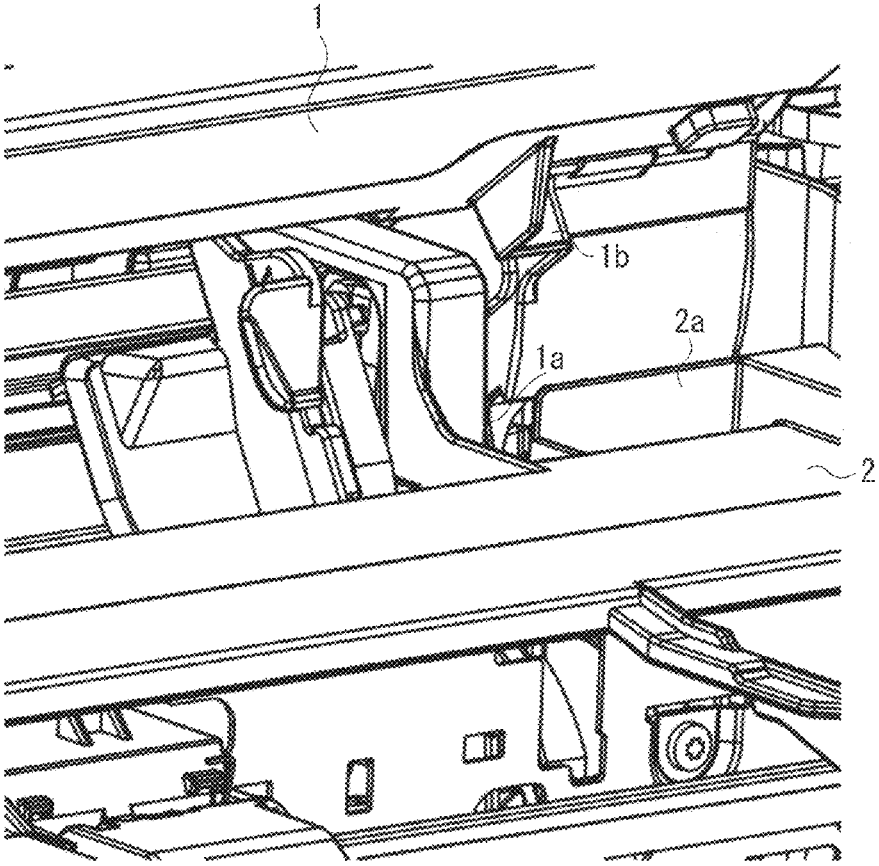
FIG. 4 is an enlarged perspective view illustrating connection portions of the cover unit and the main body.

FIG. 3 is a plan view illustrating essential components of the main body 30. FIG. 4 is an enlarged perspective view illustrating connection portions of the cover unit 1 and the main body 30. As illustrated in FIG. 3, the main body 30 includes a detection unit 20, a printing unit 32, and a carriage 33. The detection unit 20 detects opening and closing operations of the cover unit 1. The printing unit 32 discharges ink onto a printing medium. The printing unit 32 is mounted on the carriage 33 which reciprocates in a scanning direction orthogonal to a conveyance direction of the printing medium. The printing unit 32 includes a print head and ink tanks arranged above the print head. The print head includes a plurality of discharge ports, which is arranged in a position opposed to the printing medium and corresponds to a black ink and a plurality of color inks, respectively. FIG. 3 is a view from above, in which only the ink tanks of the printing unit 32 are seen. The print head is hidden under the ink tanks. Note that the printing unit 32 may only include the print head without the ink tanks. In such a configuration, the print head mounted on the carriage 33 may be supplied with ink from ink tanks installed in a different location of the inkjet printing apparatus via tubes.

As illustrated in FIG. 3, an inner wall portion 2*a* is formed on a frame 2 to be described below, and the printing unit 32 is arranged on a side opposite the detection unit 20 while being separated by the inner wall portion 2*a*. When the inkjet printing apparatus is horizontally placed, the inner wall portion 2*a* is located in a position higher than the detection unit 20 in a direction of gravity.

Figure 5:
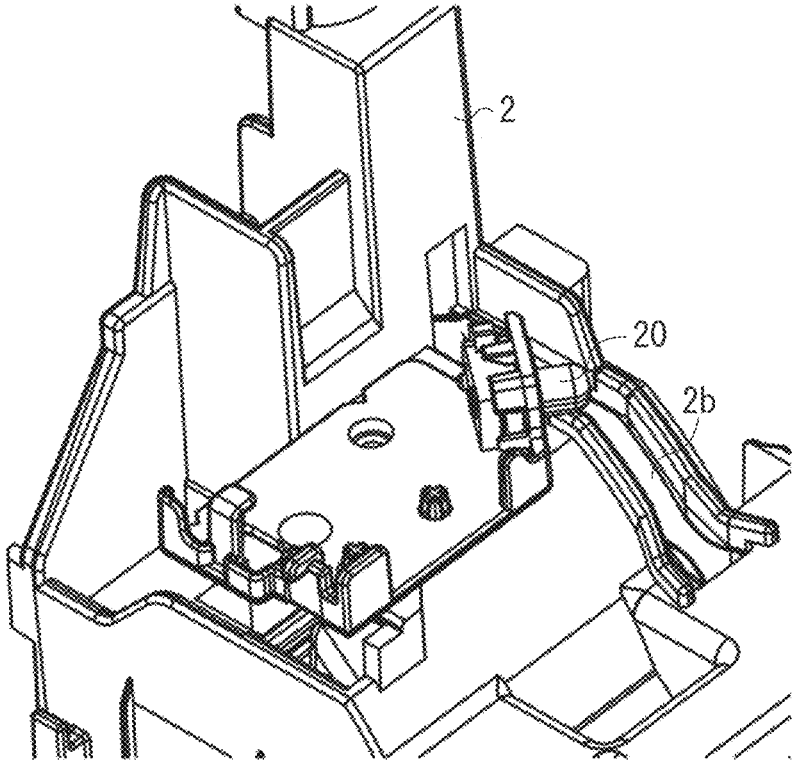
FIG. 5 is a perspective view illustrating a peripheral area of a detection unit in the main body.
Figure 6A:
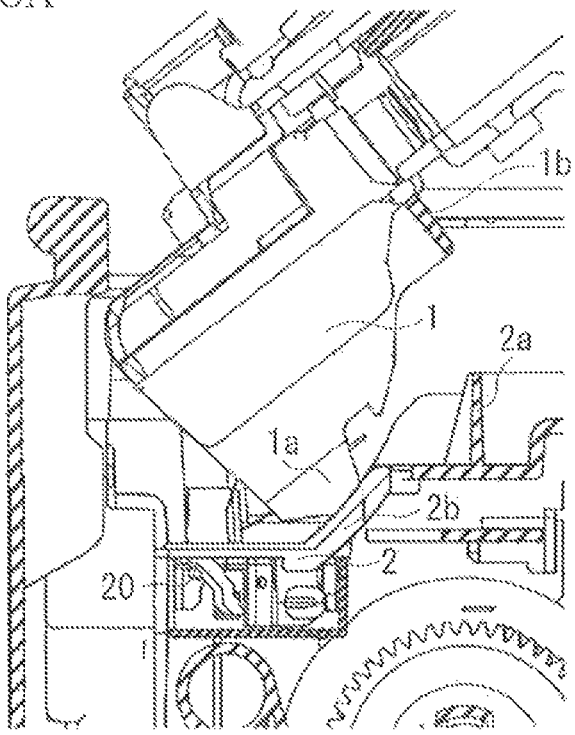
FIGS. 6A and 6B are sectional views illustrating opening and closing operations of the cover unit.
Figure 6B:
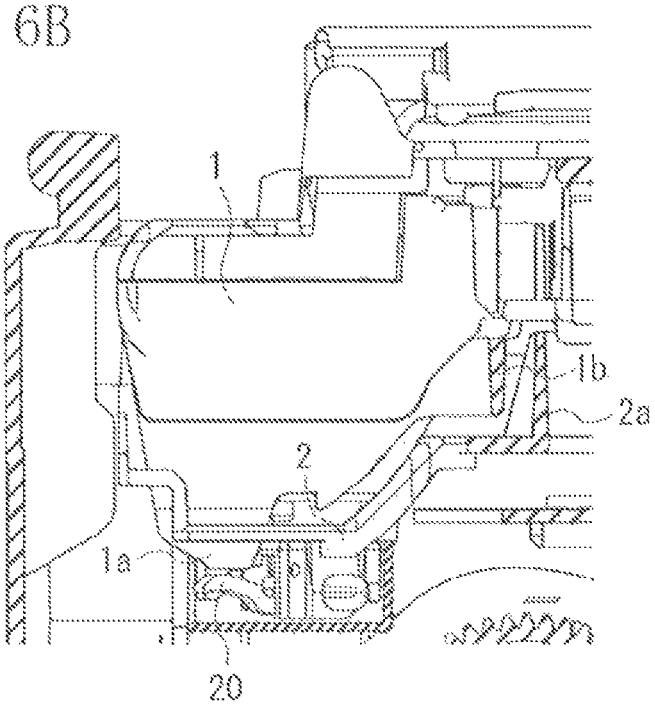

FIG. 5 is a perspective view illustrating a peripheral area of the detection unit 20 in the main body 30. FIGS. 6A and 6B are sectional views illustrating the opening and closing operations of the cover unit 1. FIG. 6A illustrates the open state where the cover unit 1 opens up the opening 31 of the main body 30. FIG. 6B illustrates the closed state where the cover unit 1 closes the opening 31 of the main body 30. While the printing unit 32 is not illustrated in FIGS. 6A and 6B, the printing unit 32 is arranged on the right of the inner wall portion 2*a*.

The detection unit 20 is located below the bearing portions 30*a* described above, and is stored in a frame 2, which is made of resin. The detection unit 20 is a leaf switch. A tactical switch or other mechanical switch may be applied to the detection unit 20 aside from a leaf switch. An optical switch such as a photointerrupter may also be applied to the detection unit 20. The switch, whether mechanical or optical, may cause a sensing malfunction or breakdown if a large amount of ink mist adheres to a sensing portion of the switch. A measure for suppress the adhesion will be described below.

In the open state illustrated in FIG. 6A, the detection unit 20 does not contact the cover unit 1. The main body 30 enters a maintenance mode for replacing the ink tanks or for handling a paper jam. To replace the ink tanks, the carriage 33, on which the ink tanks are mounted, moves to a position exposed in the opening 31. In the maintenance mode, the print head does not discharge ink onto a printing medium.

When the main body 30 shifts from the open state illustrated in FIG. 6A to the closed state illustrated in FIG. 6B, the protruding member 1*a* of the cover unit 1 descends along a hole portion 2*b* formed in the frame 2 and contacts the detection unit 20. The protruding member 1*a* displaces the detection unit 20 downward from the position illustrated in FIG. 6A. The detection unit 20 detects the closed state by the displacement. In response to the detection of the detection unit 20, the print head enters a state capable of discharging ink onto a printing medium. In the closed state illustrated in FIG. 6B, the protruding member 1*b* arranged on the cover unit 1 is opposed to the inner wall portion 2*a* on the detection unit side in parallel.

In the foregoing configuration, when the print head of the printing unit 32 discharges ink, generated ink mist may float over to the side of the detection unit 20. The inner wall portion 2*a* lying between the print head and the detection unit 20 is located in a position higher than the detection unit 20. With such a configuration, most of the ink mist generated from the print head is blocked by the inner wall portion 2*a*. As a result, the ink mist is less likely to intrude into the space where the detection unit 20 is.

Part of the ink mist can possibly intrude into the side of the detection unit 20 via a gap between a top end of the inner wall portion 2*a* and the cover unit 1. However, the cover unit 1 includes the protruding member 1*b* of plate shape opposed to the inner wall portion 2*a* on the side of the detection unit 20. The ink mist intruding via the gap between the top end of the inner wall portion 2*a* and the cover unit 1 is thus blocked by the protruding member 1*b*. This improves the effect for suppressing the intrusion of the ink mist into the space where the detection unit 20 is.

The protruding member 1*b* may be arranged on the cover unit 1 to be opposed to the inner wall portion 2*a* on the print head side. In such a case, most of the ink mist generated from the print head is blocked by the protruding member 1*b*. Part of the ink mist can possibly intrude via a gap between a bottom end of the protruding member 1*b* and the main body 30. Such ink mist is blocked by the inner wall portion 2*a*. Consequently, the effect for suppressing the intrusion of the ink mist into the side of the detection unit 20 improves like when the protruding member 1*b* is opposed to the inner wall portion 2*a* on the side of the detection unit 20.

As described above, in the closed state where the cover unit 1 is closed, the inner wall portion 2*a* separates the space where the detection unit 20 is located from the space where the print head side of the printing unit 32 is located. This significantly reduces the adhesion of ink mist to the detection unit 20, so that malfunctions and breakage of the detection unit 20 are significantly suppressed. As employed herein, to "separate" does not refer to hermetic separation of spaces in a strict sense, but may cover a somewhat open form as long as the separation has a blocking effect for reducing the intrusion of ink mist. As employed herein, such an interpretation is applied to "separate."

According to the foregoing configuration, in the open state, the user is not able to directly touch the detection unit 20 via the opening 31. This can prevent the user from accidentally pressing the detection unit 20 firmly to break the detection unit 20 when the user handles a paper jam. In addition, the formation of the inner wall portion 2*a* on the main body 30 increases a creeping distance from outside to the detection unit 20. Electrostatic breakdown of the detection unit 20 can thus be suppressed.

Figure 7:
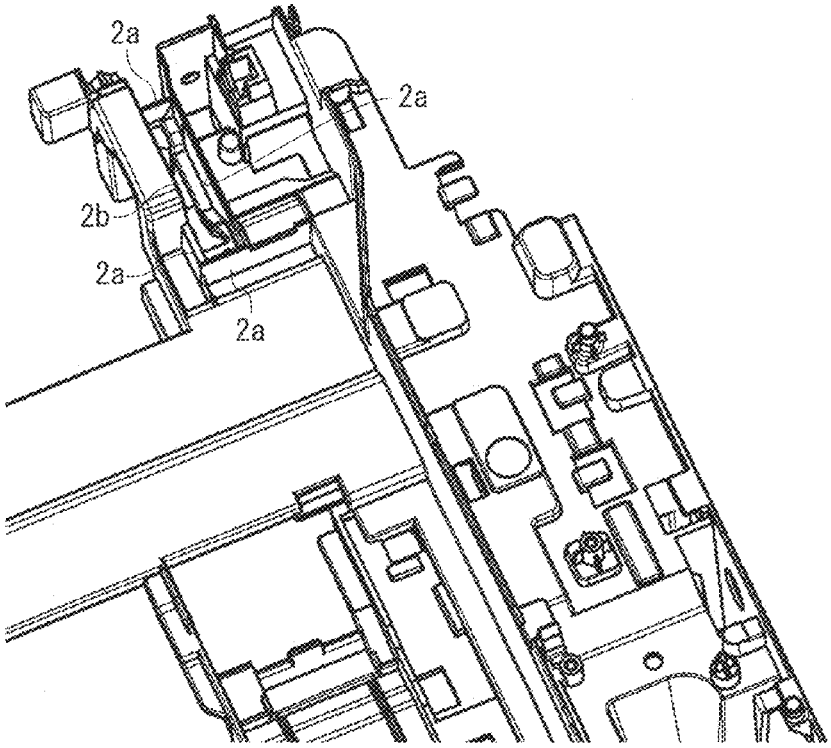
FIG. 7 is a perspective view illustrating a configuration where a plurality of inner wall portions is formed on the main body.

FIG. 7 is a perspective view illustrating a configuration where a plurality of inner wall portions 2*a* is formed on the main body 30. In FIG. 7, the plurality of inner wall portions 2*a* is formed to surround the hole portion 2*b*. The detection unit 20 is arranged under the hole portion 2*b*. As a result, the detection unit 20 is surrounded by the plurality of inner wall portions 2*a*. Such a configuration improves the hermeticity of the space where the detection unit 20 is located, so that the effect for suppressing the intrusion of ink mist improves further.

Figure 8:
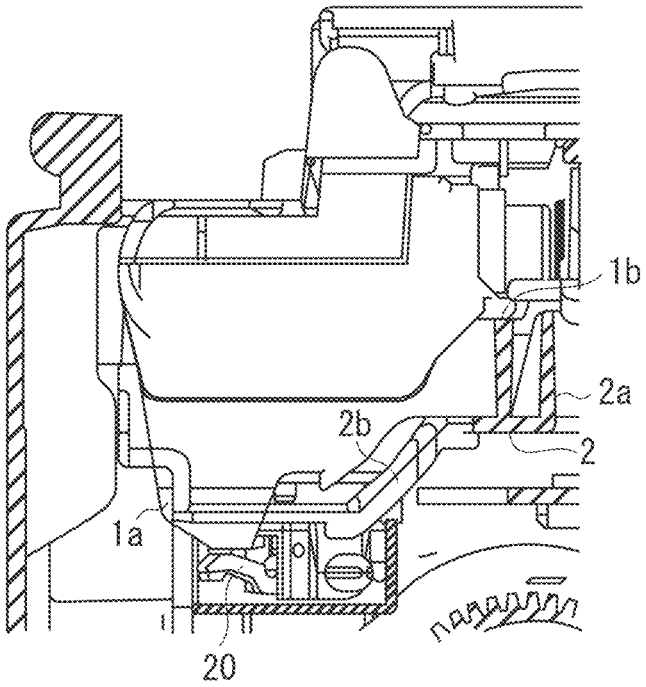
FIG. 8 is a sectional view illustrating essential components of an inkjet printing apparatus according to a second exemplary embodiment.

FIG. 8 is a sectional view illustrating essential components of an inkjet printing apparatus according to a second exemplary embodiment. Similar components to those described in the first exemplary embodiment will be indicated by the same reference numerals. A detailed description thereof will not be repeated.

FIG. 8 illustrates the inkjet printing apparatus in a closed state. In the closed state, the bottom end of the protruding member 1*b* arranged on the cover unit 1 contacts the frame 2 of the main body 30. Since the gap between the protruding member 1*b* and the frame 2 is smaller than that in the first exemplary embodiment, the intrusion of ink mist via the gap into the space where the detection unit 20 is located can be suppressed more reliably than in the first exemplary embodiment.

The configuration that the bottom end of the protruding member 1*b* contacts the frame 2 is not restrictive. A configuration such that the top end of the inner wall portion 2*a* arranged on the frame 2 contacts the cover unit 1 may be employed instead. Alternatively, a configuration such that the bottom end of the protruding member 1*b* and the top end of the inner wall portion 2*b* both contacts the cover unit 1 may be employed.

The second exemplary embodiment includes a hinge mechanism that allows the cover unit 1 to open and close the main body 30. The hinge mechanism has play that allows the cover unit 1 to move in a vertical direction with respect to the opening 31. A specific structure is described below.

Figure 9A:
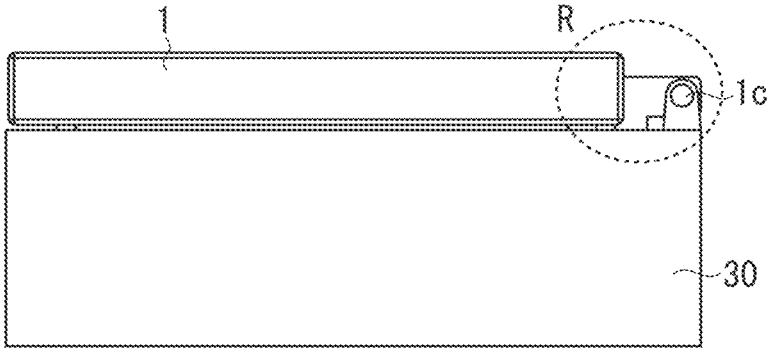
FIGS. 9A and 9B are side views of the inkjet printing apparatus illustrated in FIG. 8.
Figure 9B:
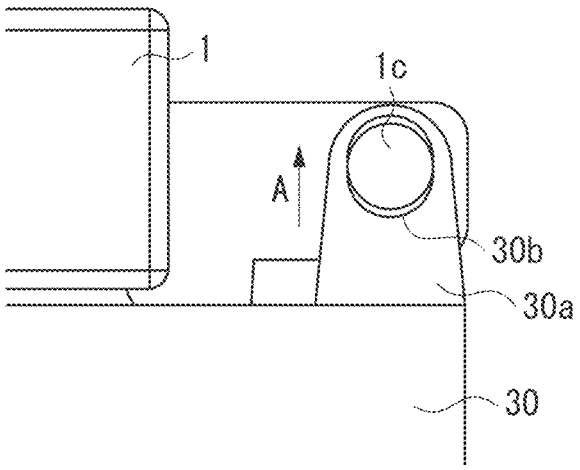

FIGS. 9A and 9B are side views of the inkjet printing apparatus illustrated in FIG. 8. FIG. 9A is a side view of the entire inkjet printing apparatus. FIG. 9B is an enlarged view of a region R surrounded by the dotted line illustrated in FIG. 9A.

As illustrated in FIG. 9B, the cover unit 1 includes a cylindrical shaft portion 1*c*. The shaft portion 1*c* is supported by a bearing portion 30*a* arranged on the main body 30. The shaft portion 1*c* and the bearing portion 30*a* constitute the hinge mechanism. The bearing portion 30*a* has an elliptical hole portion 30*b* into which the shaft portion 1*c* is inserted. The major axis of the hole portion 30*b* is in a direction A intersecting (in this example, perpendicular to; see the arrow in FIG. 9B) the virtual plane of the opening 31 (see FIG. 1B) of the main body 30. Such a hinge mechanism allows the cover unit 1 to rotate about the shaft portion 1*c* with play for some movement in the direction A.

Depending on dimension errors in the length of the protruding member 1*b* arranged on the cover unit 1, the cover unit 1 may fail to enter the closed state (the cover unit 1 may be oblique to the main body 30) when the protruding member 1*b* contacts the frame 2. The hole portion 30*b* of the bearing portion 30*a* then enables a fine adjustment to the position of the shaft portions (allows the cover unit 1 to ascend) to secure the closed state. Alternatively, the bearing portion 30*a* itself may be configured to be movable in the foregoing direction A.

Figure 10A:
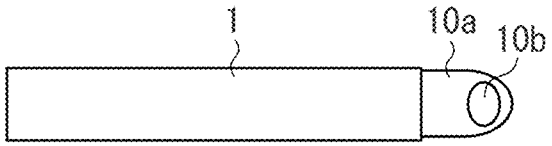
FIGS. 10A, 10B, 10C, 10D, 10E, and 10F are diagrams illustrating a configuration different from that illustrated in FIGS. 9A and 9B.
Figure 10B:
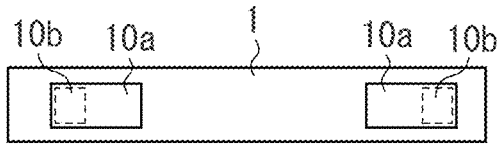
Figure 10C:
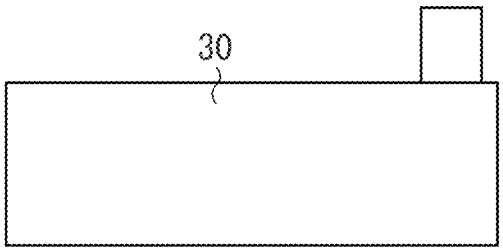
Figure 10D:
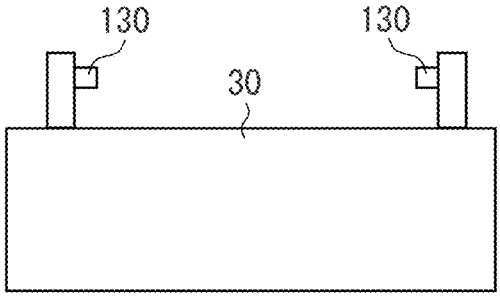
Figure 10E:
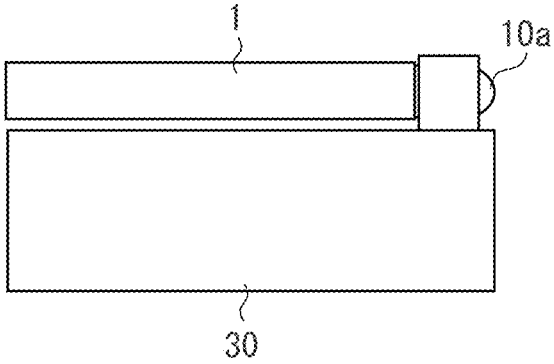
Figure 10F:
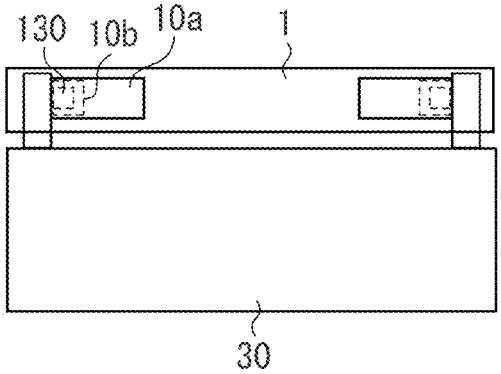

FIGS. 10A, 10B, 10C, 10D, 10E, and 10F are diagrams illustrating a configuration concerning the connection between the cover unit 1 and the main body 30, different from that illustrated in FIGS. 9A and 9B. FIG. 10A is a side vide of the cover unit 1. FIG. 10B is a rear view of the cover unit 1. FIG. 10C is a side view of the main body 30. FIG. 10D is a rear view of the main body 30. FIG. 10E is a side view illustrating a state where the cover unit 1 is attached to the main body 30. FIG. 10F is a rear view illustrating the state where the cover unit 1 is attached to the main body 30.

As illustrated in FIGS. 10A and 10B, bearing portions 10*a* similar to the bearing portion 30*a* are arranged on the rear surface of the cover unit 1. The bearing portions 10*a* have an elliptical hole portion 10*b*. As illustrated in FIGS. 10C and 10D, cylindrical shaft portions 130 similar to the shaft portion 1*c* are arrange on top of the main body 30. The shaft portions 130 and the bearing portions 10*a* constitute a hinge mechanism. The shaft portions 130 are inserted into the hole portions 10*b* in the bearing portions 10*a* (see FIG. 10F). With such a hinge mechanism, the cover unit 1 can rotate about the shaft portions 130 with play that allows movement in a direction intersecting (in this example, perpendicular to) the virtual plane of the opening 31. As a result, the position of the cover unit 1 can be adjusted as with the configuration illustrated in FIGS. 9A and 9B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-151461 filed Jul. 5, 2012, which is hereby incorporated by reference herein in its entirety.

What is claimed is:

1. A printing apparatus comprising:

a print head configured to discharge ink;

a housing in which the print head is provided, the housing having an opening;

a cover unit which is openable with respect to the opening; and a detection unit configured to detect an opening of the cover unit, wherein a first wall is provided inside the housing, arranged between the detection unit and the print head, and a second wall and a trigger portion are provided to the cover unit, and wherein, when the cover unit is in a closed state, the detection unit is triggered by the trigger portion, and the first wall and the second wall establish a double separation between a space where the detection unit is located and a space where the print head is located when the cover unit is in a closed state, whereas, when the cover unit is in an opened state, the trigger portion escapes from the detection unit and the second wall escapes from the first wall to release the double separation.

2. The printing apparatus according to claim 1, wherein the second wall has a plate shape opposed to the first wall on a side of the detection unit or a side of the print head with respect to the first wall when the cover unit is in the closed state.

3. The printing apparatus according to claim 2, wherein an end of the second wall is configured to contact the housing when the cover unit is in the closed state.

4. The printing apparatus according to claim 1, wherein a part of the first wall is configured to contact the cover unit when the cover unit is in the closed state.

5. The printing apparatus according to claim 1, further comprising a hinge mechanism configured to allow the cover unit to be rotatable, wherein the hinge mechanism has a play that allows the cover unit to move in a direction intersecting with a virtual plane of the opening.

6. The printing apparatus according to claim 5, wherein the hinge mechanism includes a cylindrical shaft provided on the cover unit and a bearing provided on the housing, and wherein the bearing has an elliptical hole into which the shaft is inserted to allow movement of the cover unit in the direction intersecting with the virtual plane of the opening.

7. The printing apparatus according to claim 5, wherein the hinge mechanism includes a cylindrical shaft provided on the housing and a bearing provided on the cover unit, and wherein the bearing has an elliptical hole into which the shaft is inserted to allow movement of the cover unit in the direction intersecting with the virtual plane of the opening.

8. The printing apparatus according to claim 1, wherein the space where the detection unit is located is surrounded by a plurality of walls.

9. The printing apparatus according to claim 1, wherein the cover unit is provided with an operation unit of the printing apparatus.

10. The printing apparatus according to claim 1, wherein the cover unit is provided with a scanner unit.

* * * * *